US007281278B1

(12) United States Patent
Biagi et al.

(10) Patent No.: US 7,281,278 B1
(45) Date of Patent: Oct. 16, 2007

(54) SANITARY PLUNGER

(76) Inventors: Daniel Biagi, 2945 Wingate St., Eugene, OR (US) 97402; Jacob C. Larson, 86336 N. Modesto Dr., Eugene, OR (US) 97402

( * ) Notice: Subject to any disclaimer, the term of this patent is extended or adjusted under 35 U.S.C. 154(b) by 412 days.

(21) Appl. No.: 11/073,169

(22) Filed: Mar. 3, 2005

(51) Int. Cl.
*E03D 11/00* (2006.01)

(52) U.S. Cl. ..... 4/255.11

(58) Field of Classification Search ..... 4/255.01, 4/255.05, 255.11, 255.12; 221/312 A; 242/593, 242/597.7
See application file for complete search history.

(56) References Cited

U.S. PATENT DOCUMENTS 3,085,585 A * 4/1963 La Rocque ..... 4/255.05 X
6,701,540 B1 3/2004 Gabriel
7,124,450 B2 * 10/2006 Davidson ..... 4/255.11

* cited by examiner

*Primary Examiner*—Robert M. Fetsuga

(57) ABSTRACT

A sanitary plunger including a hollow tubular handle shaft having a flexible force cup attached to the lower end thereof. The flexible force cup has a central opening communicating the interior of the hollow tubular handle shaft and the interior of the force cup. A spindle having a spindle shaft is positioned within the hollow tubular handle shaft. The spindle shaft is adapted to receive a roll of plastic protector bags and allow bags to be withdrawn to surround the inner surface of the force cup and the lower portion of the hollow tubular handle shaft. Means are provided for releasably holding the outer end of a plastic protector bag against the hollow tubular handle shaft.

8 Claims, 2 Drawing Sheets

SANITARY PLUNGER

BACKGROUND OF THE INVENTION

The present invention relates to a toilet plunger that prevents contamination of the force cup and adjacent handle portion during use in unplugging a toilet.

The most common tool used in unplugging a toilet is a plunger. Such plungers typically have an elongated wooden handle with a rubber force cup mounted on one end thereof. In use, the rubber force cup is inserted into the toilet and into covering contact with the bowl outlet. During use the force cup and adjacent handle portion are exposed to the unsanitary material in the toilet bowl. After use the force cup and adjacent handle portion are usually rinsed in an attempt to remove unsanitary material therefrom. Such rinsing may or may not be effective in cleansing the plunger of unsanitary matter.

SUMMARY OF THE INVENTION

It is an object of the present invention to provide a toilet plunger that prevents contamination of the force cup and adjacent handle portion during use in unplugging a toilet.

The sanitary plunger includes a hollow tubular handle shaft having a flexible force cup attached to the lower end thereof. The flexible force cup has a central opening communicating the interior of the hollow tubular handle shaft and the interior of the force cup. A spindle having a spindle shaft is positioned within the hollow tubular handle shaft. The spindle shaft is adapted to receive a roll of plastic protector bags and allow the bags to be withdrawn to surround the inner surface of the force cup and the lower portion of the hollow tubular handle shaft. Means are provided for releasably holding the outer end of a plastic protector bag against the hollow tubular handle shaft.

DESCRIPTION OF PREFERRED EMBODIMENTS

Figure 1:
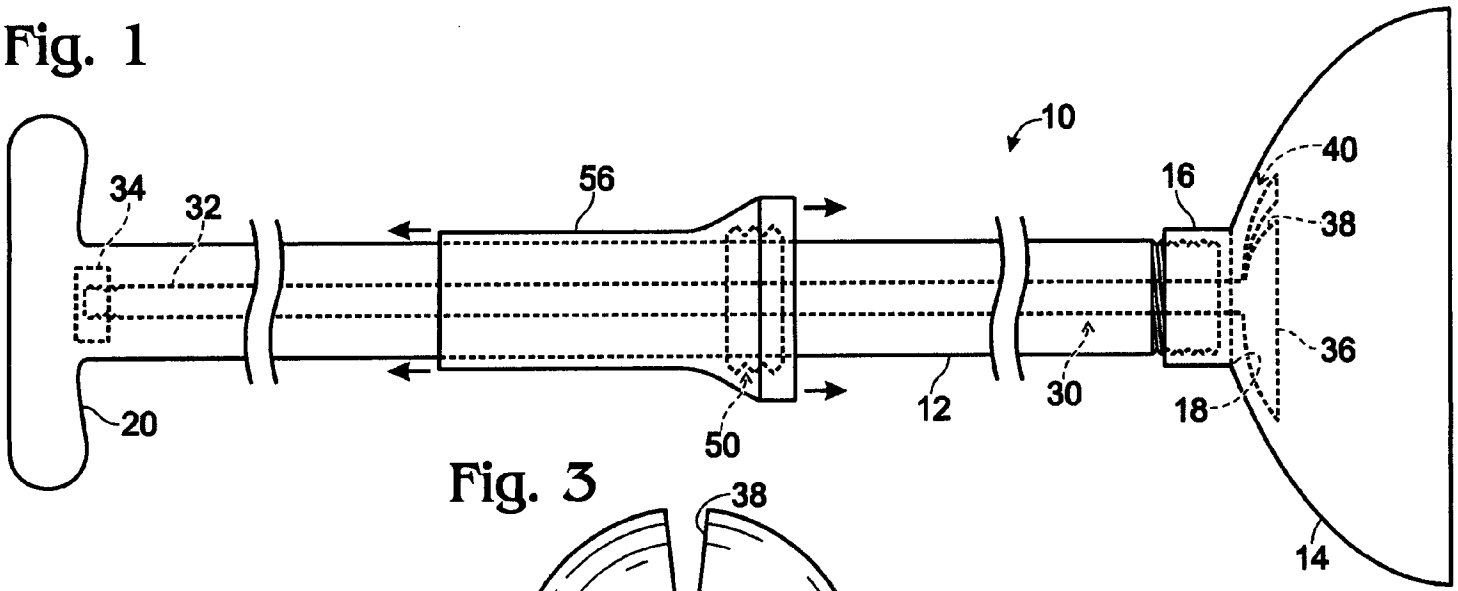
FIG. 1 is a side elevational view of the sanitary plunger of the present invention.
Figure 3:
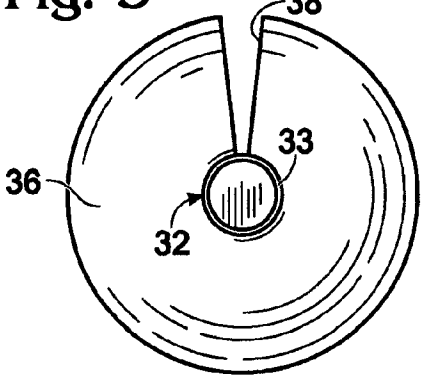
FIG. 3 is a top plan view of the spindle head thereof.
Figure 2:
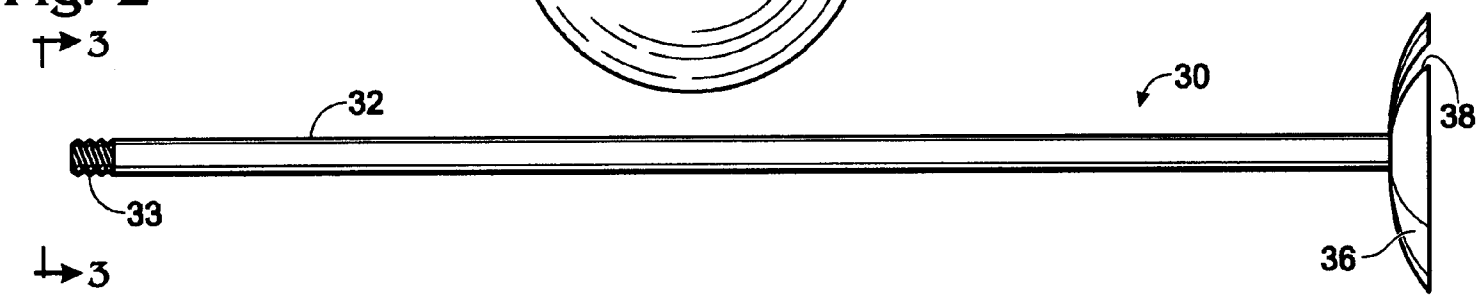
FIG. 2 is a side elevational view of the spindle and spindle head thereof.

The sanitary plunger 10 of the present invention includes a tubular handle shaft 12 and a flexible force cup 14 attached to the lower end of tubular handle shaft 12. The flexible force cup 14 is preferably made of rubber or rubber-like material of the type with which force cups are conventionally made. Force cup 14 has a handle receiving tubular extension 16 extending outwardly from the center thereof. The interior of tubular handle shaft 12 communicates with the interior of flexible force cup 14 via circular opening 18 that is coaxial with tubular extension 16. A hand grip 20 is attached to the upper end of tubular handle shaft 12.

A spindle 30 is positioned within tubular handle 12 along the longitudinal axis thereof and includes a spindle shaft 32.

The upper end of spindle shaft 32 is threaded at 33 and adapted to be screwed into centrally threaded spider member 34. Spider member 34 is attached to the interior wall of tubular handle 12 adjacent its upper end.

A cup-shaped spreader member 36 is attached to the lower end of spindle shaft 32. Spreader member 36 has a retaining slot 38 therein, extending from the periphery thereof to adjacent the center thereof. The outer surface of spreader member 36 is spaced apart from the interior surface of force cup 14 to form an annular gap or guide slot 40.

Figures 4, 5, 6:
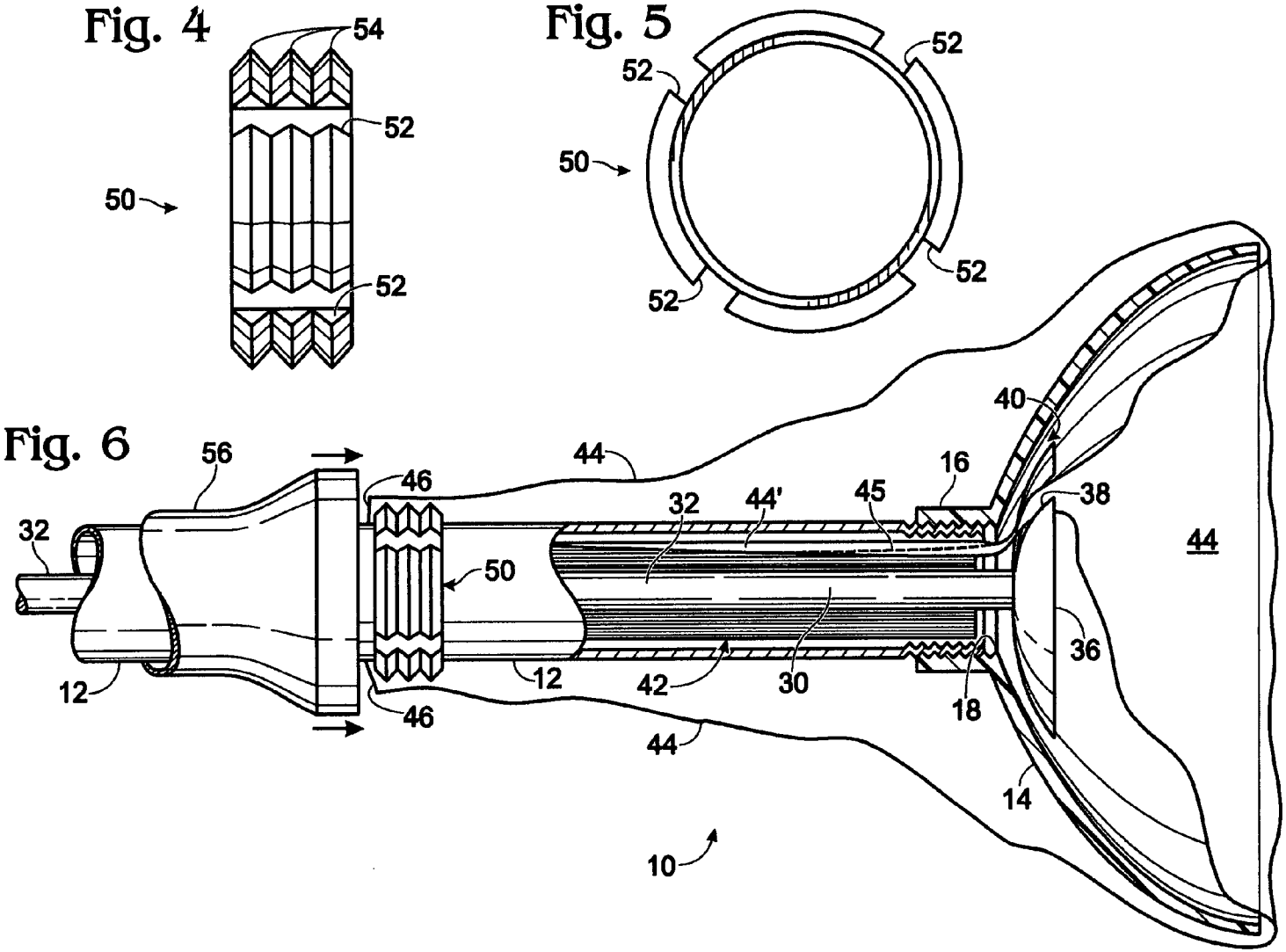
FIG. 4 is a side elevational view of the slotted holder thereof.
FIG. 5 is a top plan view of the slotted holder.
FIG. 6 is a partial elevation with cutaways, shown in partial section, of the lower portion of the sanitary plunger showing the plastic bag protector in place.

As seen in FIG. 6, a roll of plastic protector bags 42 similar to those found in grocery store produce sections is positioned onto spindle shaft 32. Outer bag 44 is attached to the next adjacent bag 44' by a perforated tear away region 45. The outer bag 44 has an outer open end 46 that is pulled through annular gap 40 and around spreader member 36, pulled around force cup 14, and finally pulled around the lower portion of tubular handle shaft 12 until it is positioned over slotted holder 50. Slotted holder 50 is attached to the outer surface of tubular handle shaft 12 at a mid-portion thereof and has a plurality of longitudinally extending slots 52 and vertically extending slots 54.

The inner end of outer bag 44 is positioned within retaining slot 38.

Tubular lock member 56, which is adapted to slide up and down tubular handle shaft 12, is then slid downwardly over slotted holder 50 to force the outer end of the bag into locking engagement therewith.

The force cup 14 and lower portion of tubular handle shaft 12 are thus covered completely by outer plastic bag 44. The plunger 10 can then be used to unclog a toilet without contact between the contents of the toilet bowl and force cup 14 and the lower portion of tubular handle shaft 12.

After use, outer plastic bag 44 is separated from the next adjacent plastic bag 44' and discarded. To ensure sanitary conditions, both outer plastic bag 44 and the next adjacent bag 44' can be removed and discarded.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A sanitary plunger comprising:

a hollow tubular handle shaft having a flexible force cup attached to the lower end thereof, said flexible force cup having a central opening communicating the interior of said hollow tubular handle shaft and the interior of said force cup;

a spindle including a spindle shaft having an upper end and a lower end, said spindle shaft adapted to receive a roll of plastic protector bags positioned within the interior of said hollow tubular handle shaft;

and means for releasably holding the outer end of a plastic protector bag at a position located at a lower to mid-portion of the exterior of said hollow tubular handle shaft.

2. The sanitary plunger of claim 1 wherein said spindle shaft is threaded at its upper end and adapted to be screwed into a centrally threaded spider attached to the interior of said hollow tubular shaft adjacent its upper end.

3. The sanitary plunger of claim 1 wherein including a bag spreader member attached to the lower end of said spindle shaft.

4. The sanitary plunger of claim 3 wherein said bag spreader member is cup shaped and whose outer surface forms an annular guide slot with the inner surface of said force cup.

5. The sanitary plunger of claim 3 wherein said bag spreader member has a bag retaining slot extending from the outer edge thereof towards the center thereof.

6. The sanitary plunger of claim 1 wherein said means for releasably holding the outer end of said plastic protector bag includes a tubular bag holder member positioned onto said tubular handle shaft.

7. The sanitary plunger of claim 6 wherein said means for releasably holding the outer end of said plastic protector bag additionally includes a tubular lock member located on said tubular handle shaft and adapted to be slid into a position over said tubular bag holder member and press said plastic protector bag against said tubular bag holder member into locking engagement therebetween.

8. The sanitary plunger of claim 1 including a hand grip attached to the outer end of said tubular handle shaft.

* * * * *